US009888788B2

(12) United States Patent
Thomas et al.

(10) Patent No.: US 9,888,788 B2
(45) **Date of Patent: *Feb. 13, 2018**

(54) PLAYARDS, CHANGING TABLE ASSEMBLIES, AND METHODS OF OPERATING THE SAME

(71) Applicant: Kolcraft Enterprises, Inc., Chicago, IL (US)

(72) Inventors: Wes Thomas, Kenosha, WI (US); Ken Zorovich, Hoboken, NJ (US)

(73) Assignee: KOLCRAFT ENTERPRISES, INC., Chicago, IL (US)

( * ) Notice: Subject to any disclaimer, the term of this patent is extended or adjusted under 35 U.S.C. 154(b) by 387 days.

This patent is subject to a terminal disclaimer.

(21) Appl. No.: 14/633,778

(22) Filed: Feb. 27, 2015

(65) Prior Publication Data

US 2015/0164240 A1 Jun. 18, 2015

Related U.S. Application Data

(63) Continuation of application No. 12/356,407, filed on Jan. 20, 2009, now Pat. No. 8,997,277.

(60) Provisional application No. 61/141,575, filed on Dec. 30, 2008.

(51) Int. Cl.

| | |
|---|---|
| ***A47D 7/00*** | (2006.01) |
| ***A47D 13/06*** | (2006.01) |
| ***A47D 5/00*** | (2006.01) |
| ***A47D 9/00*** | (2006.01) |

(52) U.S. Cl.

CPC ..... *A47D 13/063* (2013.01); *A47D 5/00* (2013.01); *A47D 9/005* (2013.01); *A47D 13/06* (2013.01); *Y10T 29/49817* (2015.01)

(58) Field of Classification Search

CPC ..... A47D 13/063; A47D 5/00; A47D 9/005; A47C 13/06

See application file for complete search history.

(56) References Cited

U.S. PATENT DOCUMENTS

| | | | | |
|---|---|---|---|---|
| 2,401,605 | A * | 6/1946 | Boren | A61G 11/00 5/655 |
| 2,475,775 | A | 7/1949 | Boren | |
| 3,135,973 | A | 6/1964 | Spencer | |
| 3,299,450 | A | 1/1967 | Gottfried et al. | |

(Continued)

OTHER PUBLICATIONS

Chinese Language "Notification of First Amendment," issued by the States Intellectual Property Office of China, in connection with Chinese application No. 200830139822.3, dated Apr. 22, 2009, 3 pages.

English Language "Notification of First Amendment," issued by the States Intellectual Property Office of China, in connection with Chinese application No. 200830139822.3, dated Apr. 22, 2009, 3 pages.

(Continued)

*Primary Examiner* — David E Sosnowski

(74) *Attorney, Agent, or Firm* — Hanley, Flight & Zimmerman, LLC

(57) ABSTRACT

A playard having a floor and an upper frame is disclosed. The upper frame includes a first end supported a first distance above the floor, a second end supported a second distance above the floor, and at least two opposed sides. Each of the opposed sides includes a first rail, a second rail, and a joint joining the first and second rails. The joint is positioned in a first plane when the joint secures the first and second rails in an erected position, the first plane being transversely oriented with respect to the floor.

26 Claims, 12 Drawing Sheets

(56) References Cited

U.S. PATENT DOCUMENTS

| | | | | |
|---|---|---|---|---|
| 3,383,718 | A | 5/1968 | Spencer | |
| 5,381,570 | A | 1/1995 | Cheng | |
| 5,560,055 | A | 10/1996 | Ziegler | |
| 5,615,427 | A | 4/1997 | Huang | |
| 5,991,944 | A | 11/1999 | Yang | |
| D432,339 | S | 10/2000 | Cromer, III | |
| 6,413,141 | B1 | 7/2002 | Putney | |
| D467,758 | S | 12/2002 | Hartenstine et al. | |
| 6,510,570 | B2 | 1/2003 | Hartenstine et al. | |
| 6,543,070 | B2 | 4/2003 | Longenecker et al. | |
| 6,550,082 | B2 | 4/2003 | Tharalson et al. | |
| 6,557,191 | B2 | 5/2003 | Bellows et al. | |
| 6,634,039 | B1 | 10/2003 | Cheng | |
| 6,735,796 | B2 | 5/2004 | Warner, Jr. et al. | |
| D494,393 | S | 8/2004 | Chen | |
| 7,043,779 | B2 | 5/2006 | Mendenhall et al. | |
| 7,055,191 | B1 | 6/2006 | Chen | |
| 7,108,443 | B2 | 9/2006 | Chen | |
| D537,285 | S | 2/2007 | Chen | |
| 7,228,575 | B2 | 6/2007 | Chen | |
| 7,337,479 | B2 | 3/2008 | Van Huystee | |
| 7,343,634 | B2 | 3/2008 | Song | |
| D585,678 | S | 2/2009 | Thomas et al. | |
| 8,387,178 | B2 * | 3/2013 | Rivera | A47D 13/063 403/102 |
| 8,966,680 | B2 * | 3/2015 | Dowd | A47D 13/063 5/98.1 |
| 8,997,277 | B2 * | 4/2015 | Thomas | A47D 5/00 5/414 |
| 2006/0130237 | A1 | 6/2006 | Clapper et al. | |
| 2008/0022457 | A1 | 1/2008 | Wu | |
| 2008/0098530 | A1 | 5/2008 | Chen et al. | |
| 2009/0113622 | A1 | 5/2009 | Hartenstine | |
| 2009/0113624 | A1 | 5/2009 | Tuckey | |

OTHER PUBLICATIONS

Chinese Language, "Notice of Decision of Grant of Patent Right for Design and Completion of Formalities for Patent Register," issued by The States Intellectual Property Office of China, in connection with Chinese application No. 200830139822.3, dated Sep. 30, 2009, 1 page.

English Language, "Notice of Decision of Grant of Patent Right for Design and Completion of Formalities for Patent Register," issued by The States Intellectual Property Office of China, in connection with Chinese application No. 200830139822.3, dated Sep. 30, 2009, 1 pages.

United States Patent and Trademark Office, "Non-Final Office Action", issued in connection with U.S. Appl. No. 12/356,407, dated Dec. 24, 2009 (10 pages).

United States Patent and Trademark Office, "Final Office Action", issued in connection with U.S. Appl. No. 12/356,407, dated Sep. 10, 2010 (11 pages).

United States Patent and Trademark Office, "Patent Board Decision", issued in connection with U.S. Appl. No. 12/356,407, dated Sep. 25, 2014 (10 pages).

United States Patent and Trademark Office, "Notice of Allowance", issued in connection with U.S. Appl. No. 12/356,407, dated Oct. 9, 2014 (5 pages).

United States Patent and Trademark Office, "Examiner's Answer to Appeal Brief", issued in connection with U.S. Appl. No. 12/356,407, dated Dec. 21, 2011 (14 pages).

United States Patent and Trademark Office, "Corrected Notice of Allowance", issued in connection with U.S. Appl. No. 12/356,407, dated Oct. 24, 2014 (7 pages).

United States Patent and Trademark Office, "Notice of Allowance", issued in connection with U.S. Appl. No. 12/356,407, dated Feb. 25, 2015 (5 pages).

* cited by examiner

PLAYARDS, CHANGING TABLE ASSEMBLIES, AND METHODS OF OPERATING THE SAME

CROSS REFERENCE TO RELATED APPLICATIONS

This patent arises from a continuation of U.S. patent application Ser. No. 12/356,407, filed on Jan. 20, 2009, which is a non-provisional application claiming priority to U.S. Provisional Application Ser. No. 61/141,575, filed Dec. 30, 2008. U.S. patent application Ser. No. 12/356,407 and U.S. Provisional Application Ser. No. 61/141,575 are hereby incorporated herein by reference in their entireties.

FIELD OF THE DISCLOSURE

This disclosure relates generally to child care products, and, more particularly, to playards, changing table assemblies, and methods of operating the same.

BACKGROUND

In recent years, portable playards or cribs have become very popular. Portable playards typically include a frame, a flexible enclosure supported by the frame, and a removable floor board or mat. The frame is largely or completely contained within the flexible enclosure so that there are few if any loose parts when the frame is collapsed or when the frame is erected. When collapsed, the portable playard typically has a compact form factor to enable easy transport and storage of the playard. Sometimes, the floorboard is wrapped around the collapsed frame to prevent the frame from inadvertently leaving the collapsed state.

DETAILED DESCRIPTION

Figure 1:
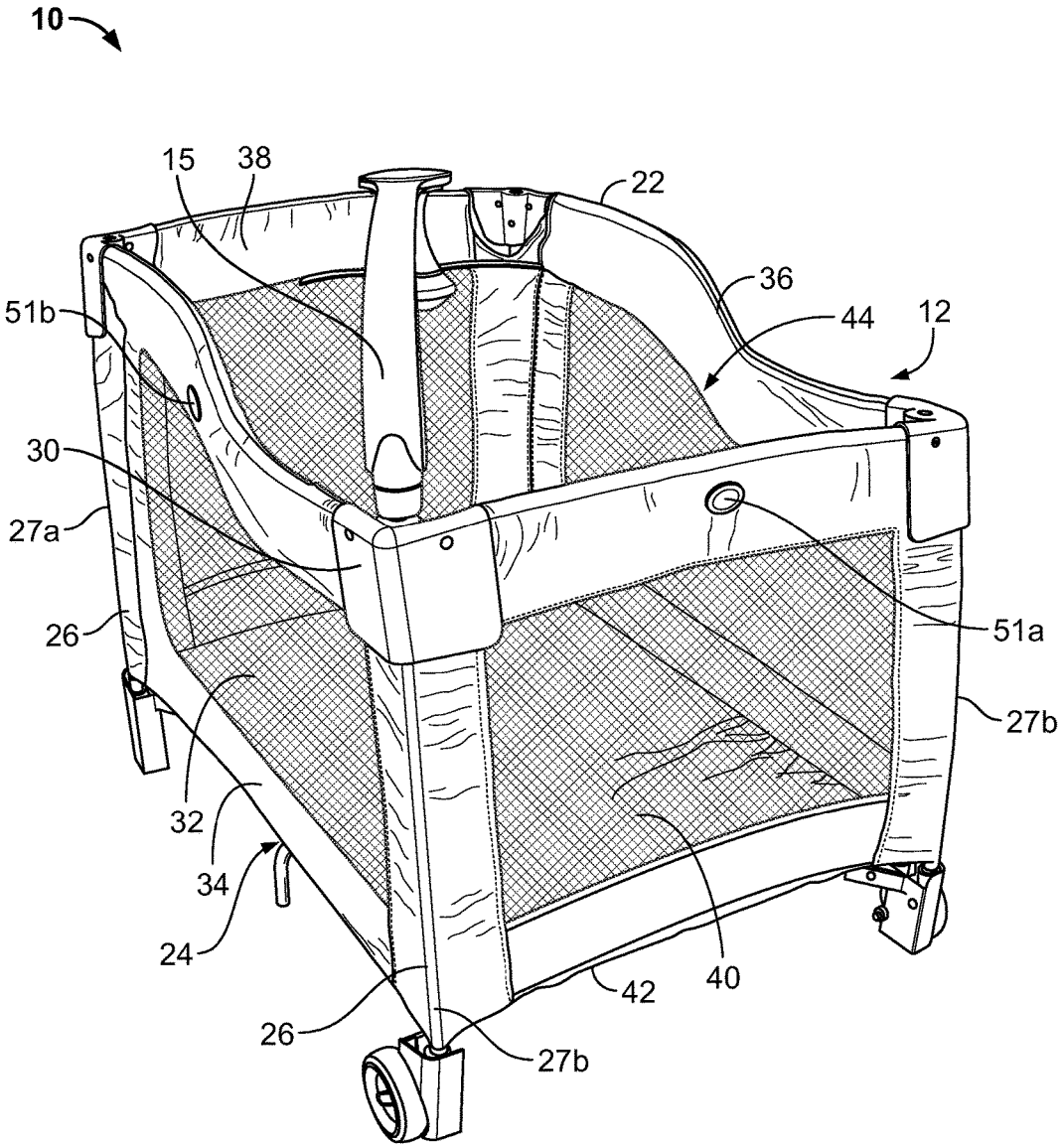
FIG. 1 is a left front perspective view of an example playard constructed in accordance with the teachings of the present disclosure

FIGS. 1-13 illustrate example configurations of playards, and playard and changing table assemblies constructed in accordance with the teachings of the present disclosure. Each illustrated example playard may be movable between a collapsed position (not shown) for transportation or storage, and an extended position (as shown) for use. The illustrated playards include an upper frame having a swooping profile. More specifically, a first pair of posts at a first end of the playard has a first height and a second pair of posts at a second, opposite, end of the playard has a second height. The second height is different from the first height. The upper frame of the illustrated example has four collapsible sides. One pair of the sides are connected between respective ones of the first and second pair of posts (e.g., between one of the first posts and one of the second posts). To accommodate the difference in height between these posts, these sides step downward in the general area of a pivot joint. In the illustrated example, each of these sides includes a first rail, a rail joint, and a second rail. One of the rails has a downwardly curved profile when viewed from the front (see FIG. 5) and the other has an upwardly curved profile when viewed from that same perspective. Alternatively, the rails could be straight. To provide the step down, the ends of the first and second rails are bent (one downwardly, and one upwardly) and the joint pivotally joining the first and second rails is positioned in a plane that is transversely oriented relative to a floor board of the playard.

In the illustrated examples, an optional child care accessory such as, for example, a mobile, storage compartment, changing table, etc. is removably mountable to both the higher side and the lower side of the playard (at different times). The changing table of the illustrated example provides a convenient platform for holding and/or changing an infant, for storing items, for providing additional storage capacity, etc.

Traditionally, changing tables have been configured to be attached to a specific location along a portion of the top rails of the playard. In such configurations, the height of the playard's top rails dictates at least an initial height of the changing table's changing surface. Safety standards, however, currently limit the height or distance between the changing table and the playard in order to avoid potential entrapment of a child or infant between the changing table and the playard. Advantageously, the example changing tables disclosed herein are adjustable in height during use, but avoid potential entrapment issues between the changing table and the playard. In particular, in the illustrated example playards and changing table assemblies, the changing table may be mounted to the first end of the playard to present the changing table surface at a first height, and/or may be mounted to the second end of the playard to present the changing table surface at a second height which is different from the first height. Thus, the structure of the playard (e.g., having the first set of posts with a first height and the second set of the posts with the second height) provides height adjustability of the changing table. Moreover, this height adjustability is achieved without changing a distance between the bottom of the changing table and the closest top surface of the playard when the changing table is mounted on the playard and thusly ensuring no entrapment issues are created by changing the height of the changing table relative to the playard's top rails.

Turning more specifically to FIGS. 1-10, an example playard and changing table assembly 10 includes a foldable playard 12 and an optional childcare accessory such as, for example, a removable changing table 14 or a mobile 15. In the examples of FIGS. 3, 5, 7, and 9 the changing table 14 is coupled to the playard 12 in a first location (e.g., a first end), and in the examples of FIGS. 4, 6, 8, and 10 the changing table 14 is coupled to the playard 12 in a second location (e.g., a second end). When installed, the example changing table 14 provides a convenient raised platform or holding area to facilitate child care, such as, for example, dressing or changing an infant, toddler, or other child. The example of FIGS. 3, 5, 7, and 9, illustrate the changing table 14 at a first height above the playard support surface, while the example of FIGS. 4, 6, 8, and 10, illustrate the changing table 14 at a second height above the playard support surface. In both examples, the distance between the changing table and a portion of the an upper frame of the playard directly below the changing table are sufficiently small to prevent a child's head from entering therebetween and thus, avoid an entrapment hazard.

The playard 12 of the illustrated example has a frame 20 including a collapsible upper frame 22, a collapsible lower frame 24, and four upright corner posts 26 that are coupled between the upper frame 22 and the lower frame 24. As will be described in detail below, two of the four upright corner posts 27A extend a first height above the lower frame 24 while the other two upright corners post 27B extend a second height above the lower frame 24. The second height is different than the first height. Additionally, the example changing table 14 is mounted to the upper frame 12 via any suitable fastener, including, for example, by insertion of the changing table 14 into at least one of a plurality of upper corner housings 30 or end caps, disposed at, or near, the junction of the upper frame 22 and each upright corner post 26. Therefore, the changing table 14, if present, may be installed at either of two different heights above the lower frame 24, and thus at either of two different heights above the support surface upon which the playard 12 rests. Furthermore, in this example at least a portion of the changing table 14 extends over the playard 12, while still permitting access to the child receiving space and while avoiding an entrapment hazard. The example changing table 14 may be disposed at either end of the upper frame 22 of the playard 12. The example changing table 14 may also be used with any other type of playard and/or crib, such as, for example, a conventional crib, which is or is not foldable, provided the ends of the playard and/or crib have different heights.

Figure 2:
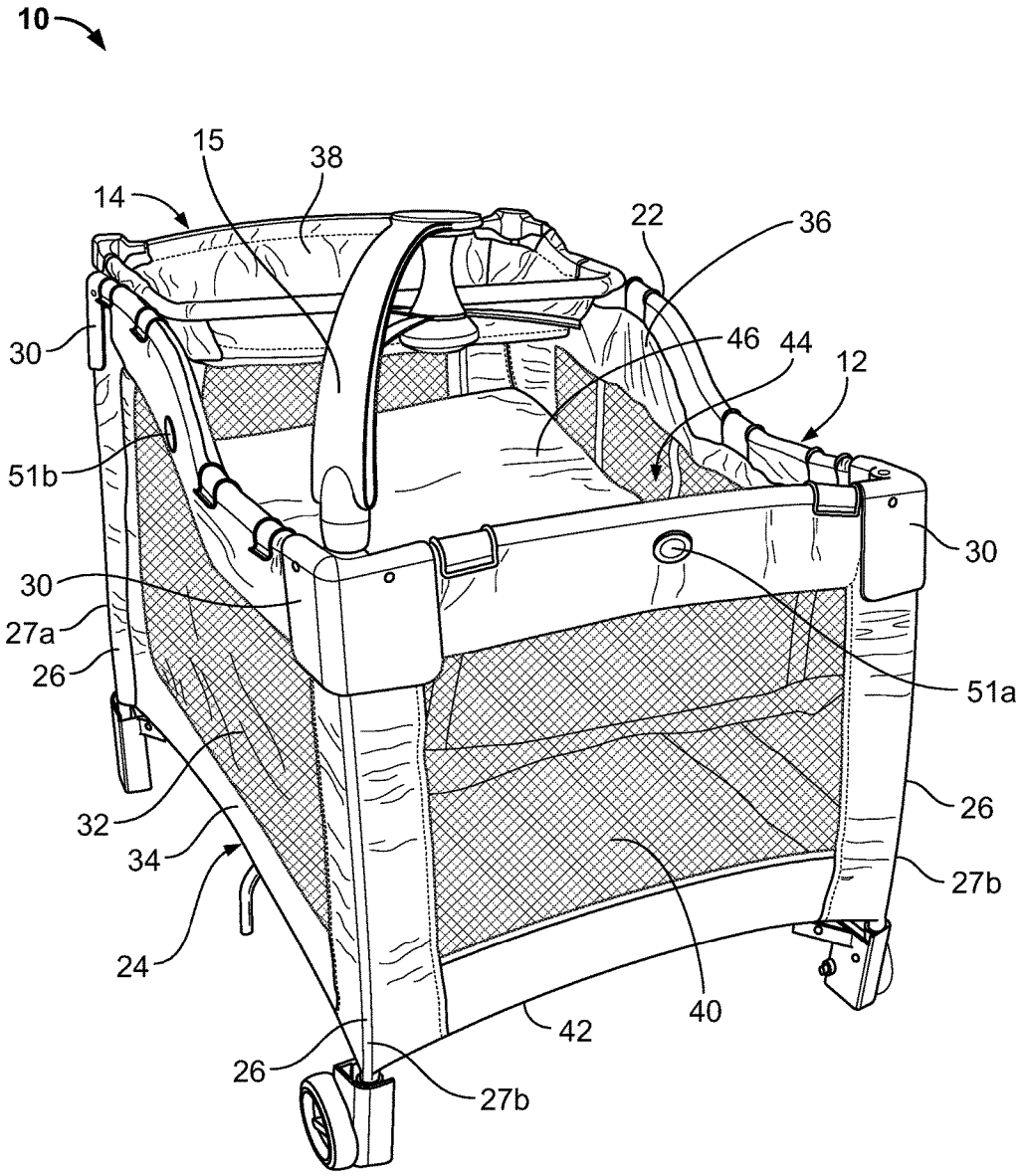
FIG. 2 is a left front perspective view of an example playard and changing table assembly constructed in accordance with the teachings of the present disclosure
Figure 3:
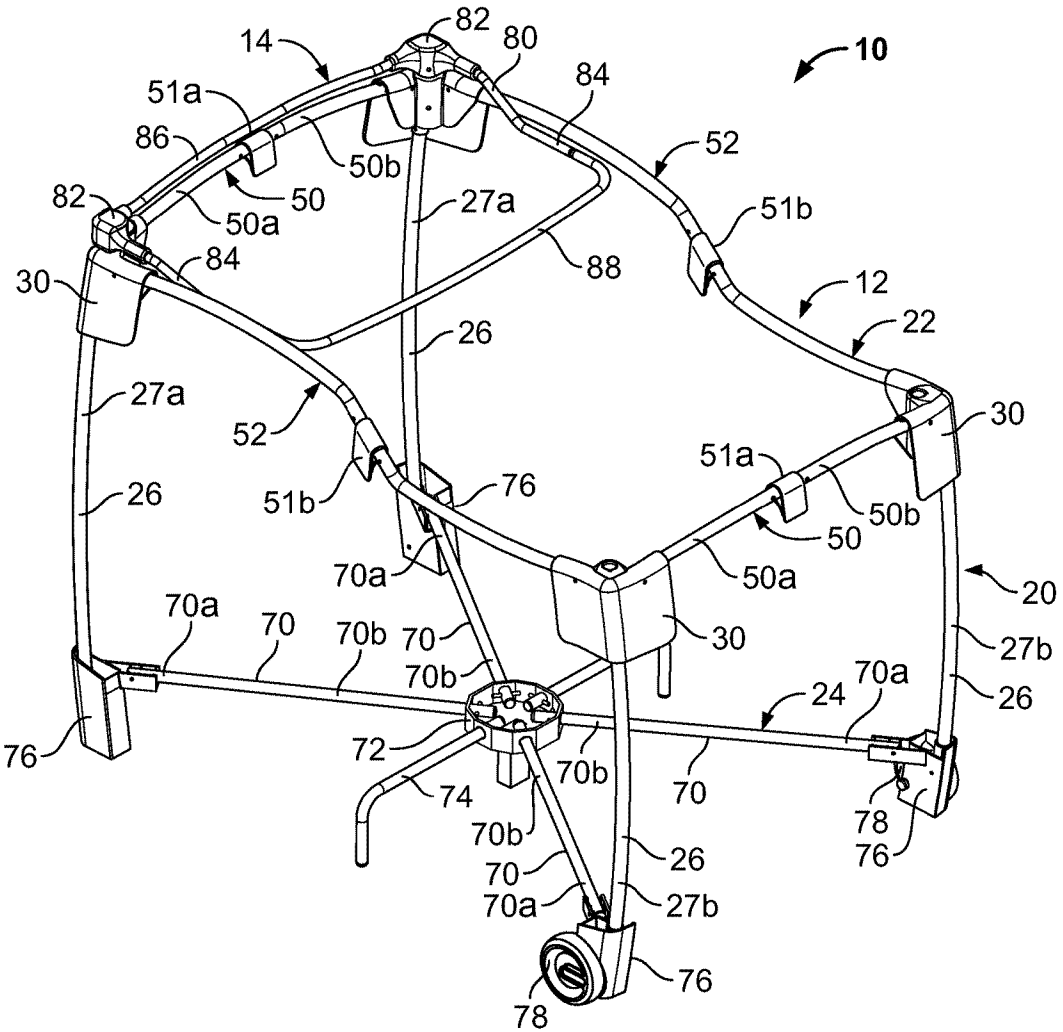
FIG. 3 is a right front perspective view of an example frame of the example playard and changing table assembly of FIG. 2, showing the example changing table mounted to the playard in a first position.
Figure 4:
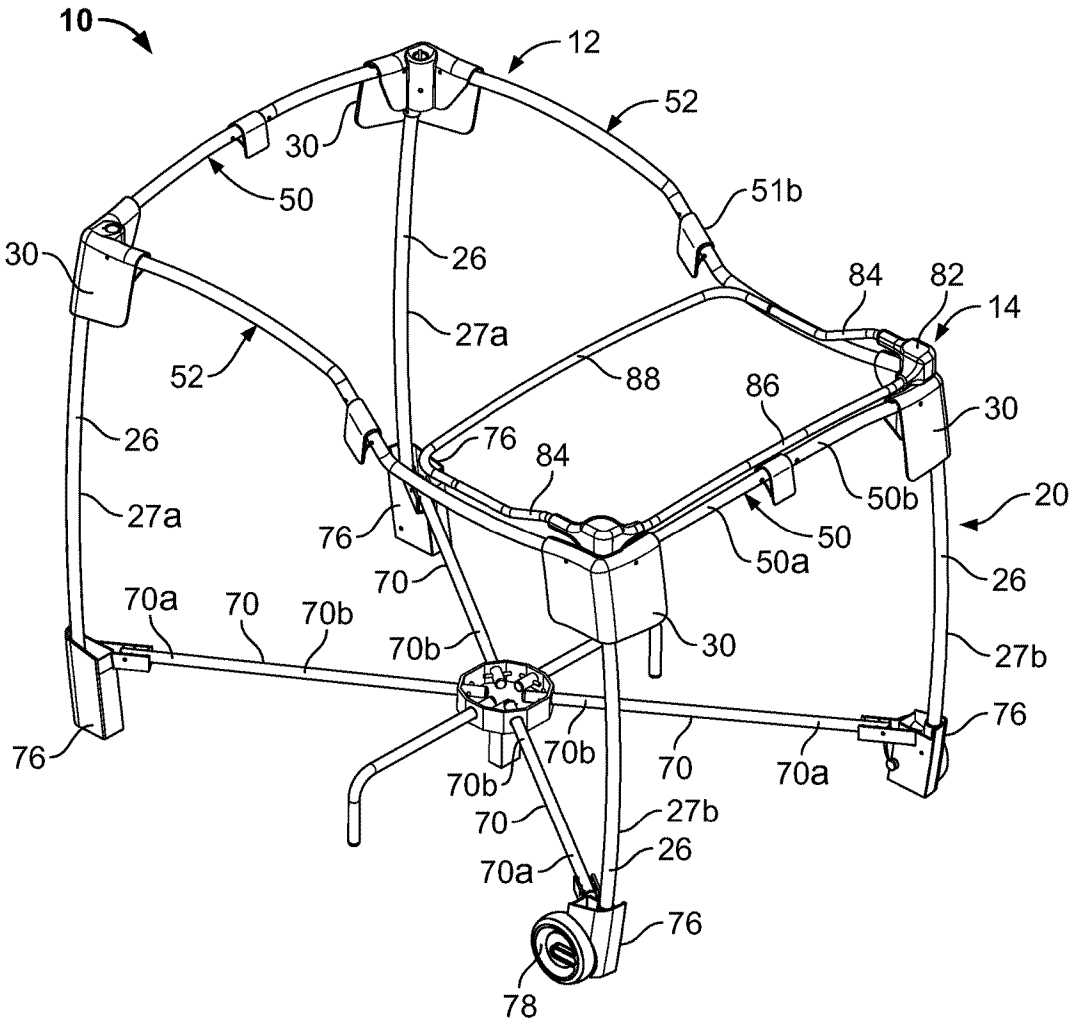
FIG. 4 is a right front perspective view similar to FIG. 3, but showing the example changing table mounted in a second position.

FIGS. 1 and 2 show a fabric enclosure 32 secured to the frame 20. The enclosure 32 of the illustrated example includes a front side panel 34, a rear side panel 36, and end side panels 38, 40. For convenience of description, two of the panels (34, 36) will be referred to as front and rear panels, and two of the panels (38, 40) will be referred to as end panels. It will be understood, however, that the relative terms (front, back, sides, ends, upper, lower, etc) describing any of the panels 34, 36, 38, 40, and/or any other component of the example playard and changing table assembly 10 may vary depending upon the orientation of the playard 12 and/or the changing table 14 and are not intended to be restrictive, but illustrative. The example enclosure 32 also includes a floor panel 42, provided to cover the lower frame 24. Together, the panels 34, 36, 38, 40, and 42 define a child receiving space 44. Each of the panels 34, 36, 38, 40, and 42 may be constructed of any suitable pliable material and are shown, for instance, with the front, rear, and side panels 34, 36, 38, 40, having mesh portions for improved visual access and ventilation of the enclosure 32.

The example playard 12 may also include a removable padded floor 46 provided to cover the floor panel 42 and to provide a support surface when the playard is extended for use in the erected position (see, for example, FIGS. 5-10). The padded floor 46 may also be disposed as a bassinet a distance above the lower frame 24, such as for example, via hooks, clips, straps, and/or any suitable fasteners to provide a higher support surface (FIG. 2). The padded floor 46 may be constructed of any suitable materials. In the illustrated example it includes a plurality of fairly rigid sections (e.g., cardboard and/or pressed wood panels with foam or other padding) enclosed by a pliable fabric covering.

As shown in FIGS. 3-10, the upper frame 22 of the example playard 12 includes a pair of collapsible upper end rail members 50, and a pair of collapsible upper side rail members 52. Each upper end rail member 50 includes a pair of rails 50*a*, 50*b* that are pivotably coupled by a first rail joint 51*a*. Similarly, each upper side rail member 52 includes a pair of rails 52*a*, 52*b* that are pivotally coupled by a second rail joint 51*b*. Each of the example first and second rail joints 51*a*, 51*b* can be constructed in any desired manner to provide a locking mechanism to selectively form a relatively rigid upper rail member 50, 52 when the playard 12 is erected for use while also permitting the upper rail members 50, 52 to be pivoted or otherwise moved, to move the playard 12 into the collapsed, or folded state. An example construction of the rail joints 51*a*, 51*b* is disclosed in U.S. Pat. No. 6,250,837 and is incorporated herein by reference in its entirety. The upper end rail members 50 and upper side rail members 52 of the upper frame 22 may be constructed of any suitable material such as with relatively rigid (metal or plastic) tubing, or the like.

Figure 5:
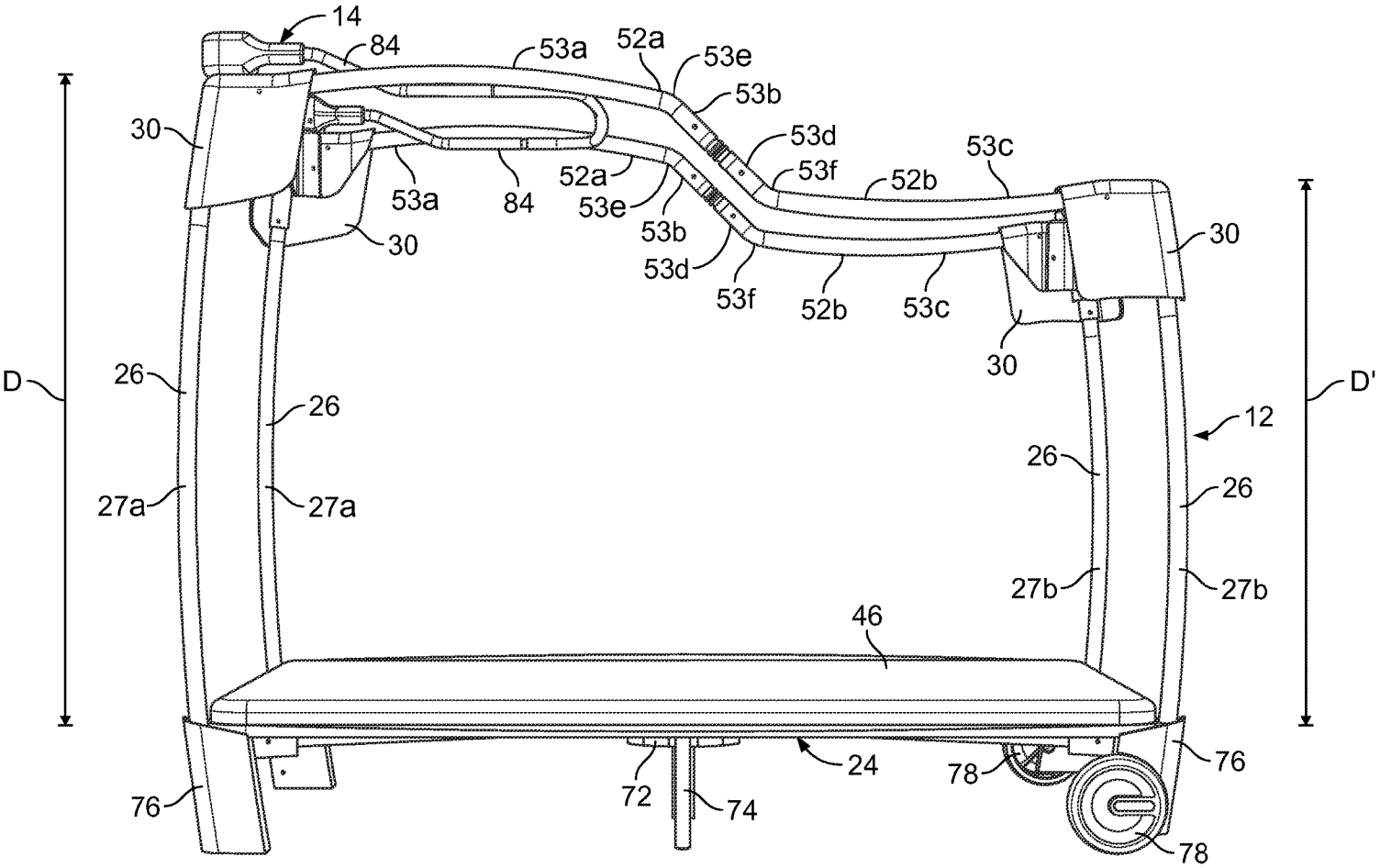
FIG. 5 is a front plan view of the example playard and changing table assembly of FIG. 3, showing the example changing table in the first position.
Figure 6:
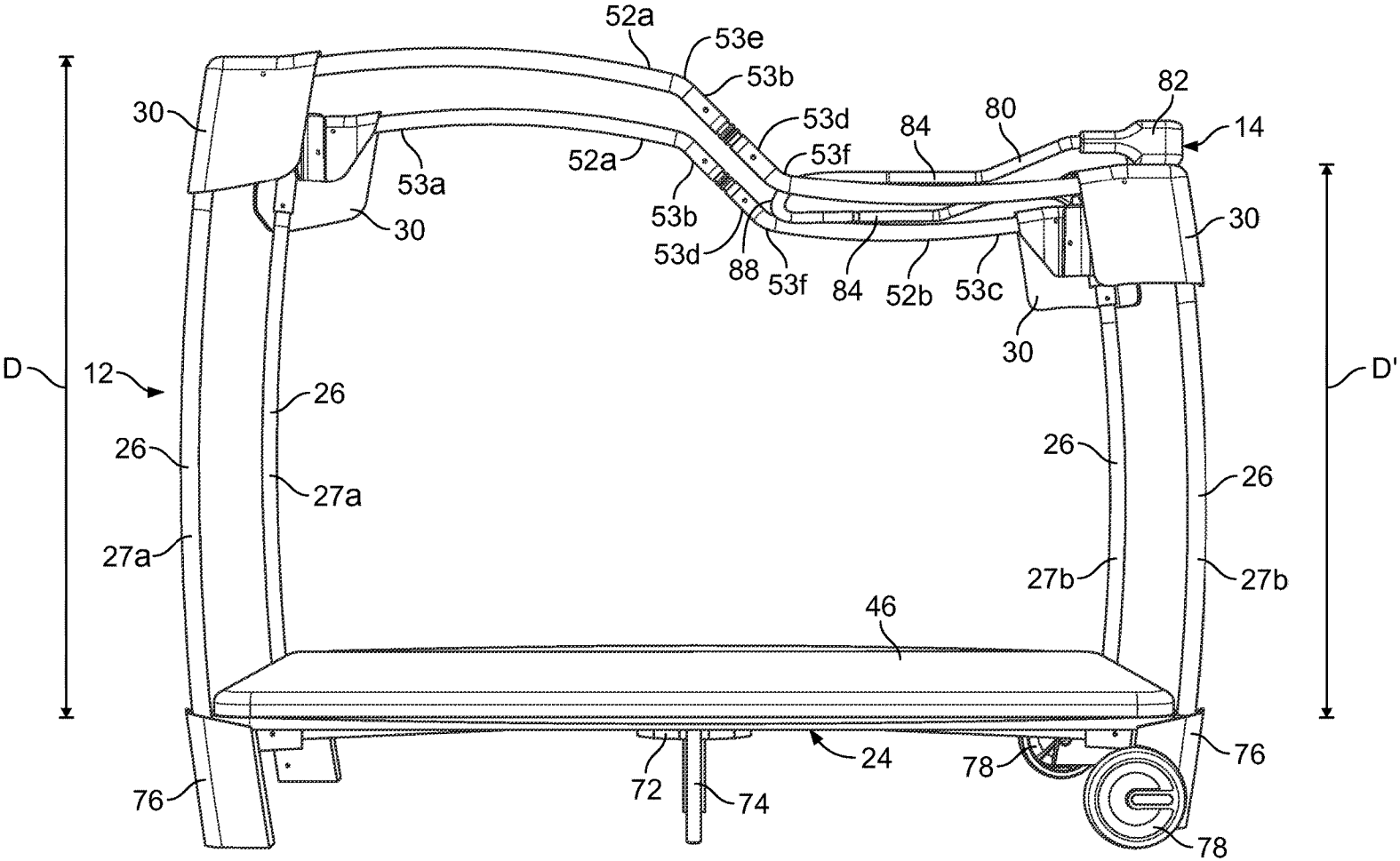
FIG. 6 is a front plan view similar to FIG. 5, but showing the example changing table mounted in the second position.
Figure 7:
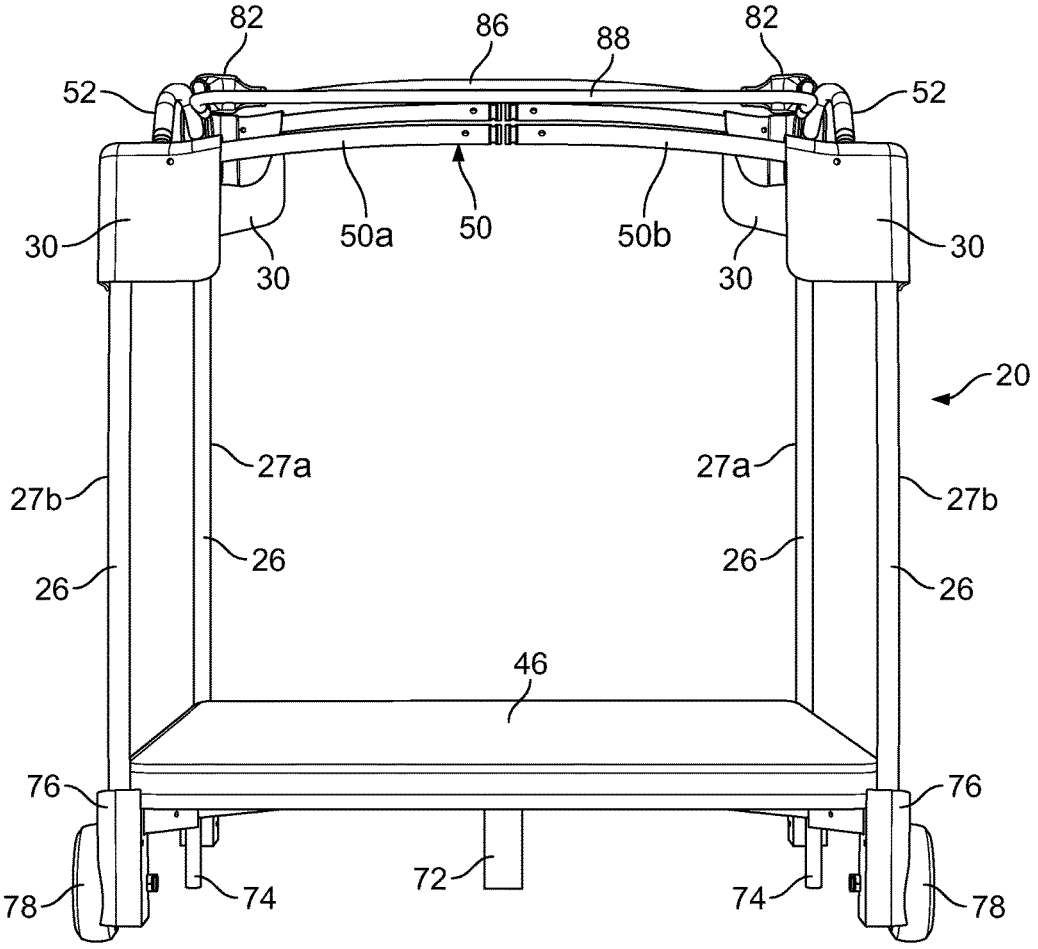
FIG. 7 is a right side plan view of the example playard and changing table assembly of FIG. 3, showing the example changing table in the first position.
Figure 8:
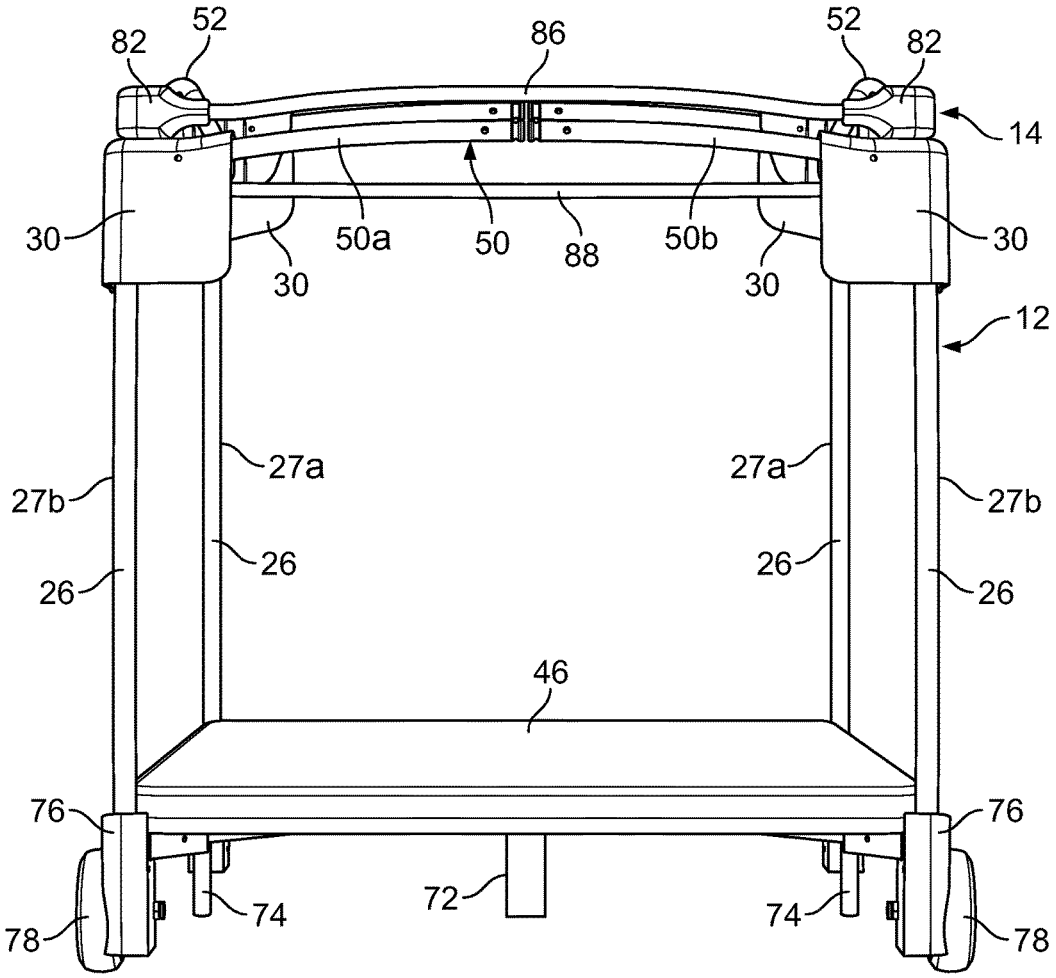
FIG. 8 is a right side plan view similar to FIG. 7, but showing the example changing table mounted in the second position.
Figure 9:
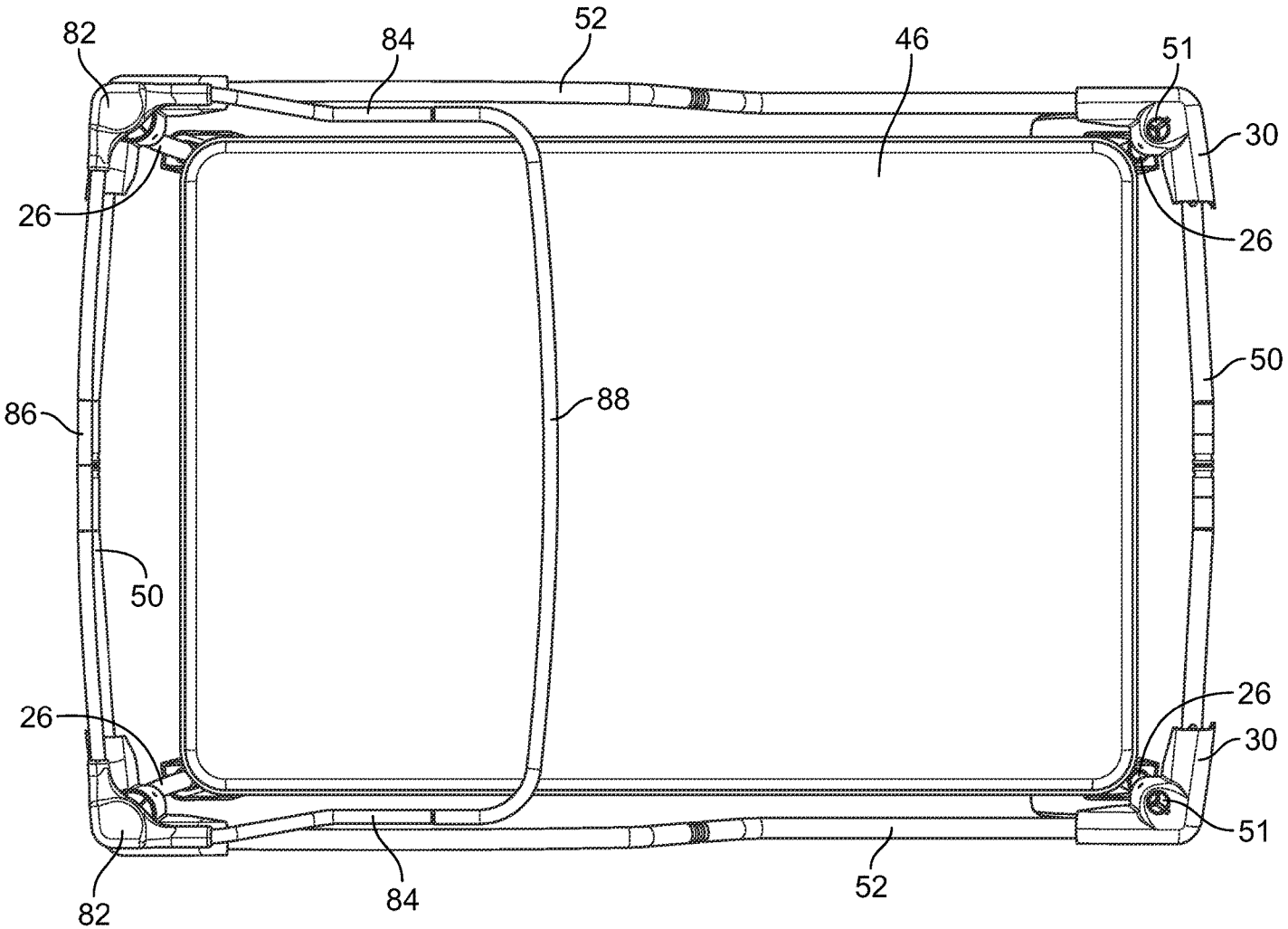
FIG. 9 is a top plan view of the example playard and changing table assembly of FIG. 3, showing the example changing table in the first position.
Figure 10:
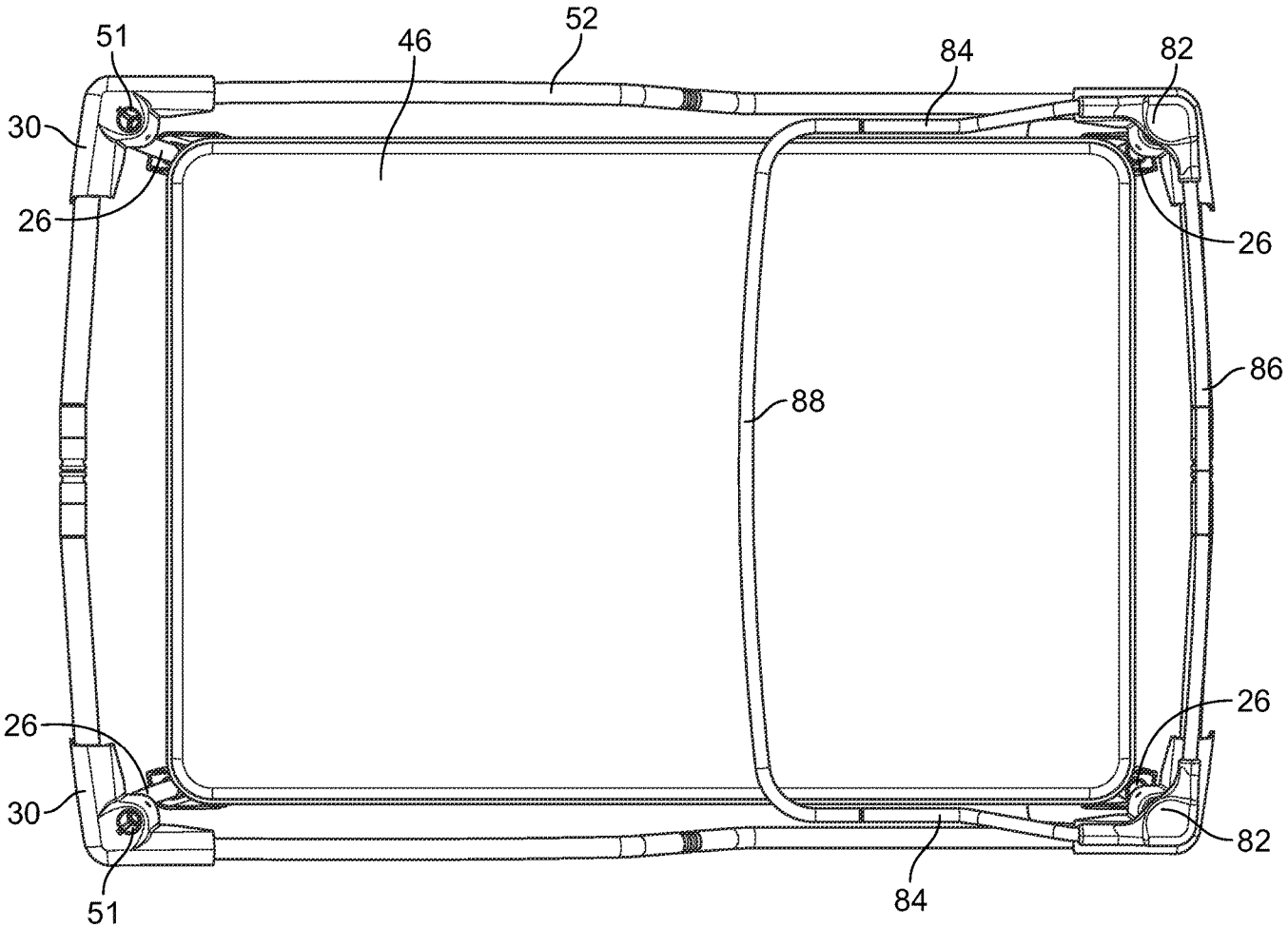
FIG. 10 is a top plan view similar to FIG. 9, but showing the example changing table mounted in the second position.

As illustrated in FIGS. 5 and 6, each of the upper side rail members 52 extends between two of the upper corner housings 30. Additionally, because two of the four upright corner posts 26 (e.g. posts 27*a*) extend a first height above the lower frame 24 and the other two (e.g. post 27*b*) extend a second height above the lower frame 24 different than the first height, the upper corner housings 30 of the opposite ends of the playard 12 are similarly disposed at different heights above the lower frame 24. Accordingly, each of the upper side rails 52 includes a first rail end that is located a first height above the lower frame (e.g. coupled to posts 27*a*), and a second rail end that is located at a second height above the lower frame (e.g. coupled to posts 27*b*).

The example upper side rail members 52 each include a generally downwardly curved rail (52*a*) and a generally upwardly curved rail (52*b*). Specifically, the example rail 52*a* includes an arcuate portion 53*a* and a substantially linear portion 53*b*. Similarly, the example rail 52*b* includes an arcuate portion 53*c* and a substantially linear portion 53*d*. In the illustrated examples, the arcuate portions 53*a* and 53*c* are separated from the linear portions 53*b* and 53*b* by a bending portion 53*e* and 53*f*, respectively. The bending portions 53*e*, 53*f* of the illustrated example are bent substantially the same, but opposite, to bring the linear portions 53*b* and 53*d* into co-alignment when the playard is in the erected condition. In particular, some of the bending portions form a concave downward curve and other of the bending portions form a concave upward curve. In the illustrated example, the linear portions are co-linearly aligned. In this example arrangement, the rails 52*a* and 52*b* are aligned so that they can each be pivotally attached to the rail joints 51*b*, as illustrated in FIG. 2. The swooping nature of the rails provides a pleasing visual appearance. It also provides easy access to a child and/or object located within the playard. While in the illustrated example, at least a portion of each of the rails 52*a* and 52*b* is generally arcuate (e.g., non-linear) throughout the length of the rails portions 53*a*, 53*c*, the rails 52*a* and 52*b* may be formed with any or all of the rails having a straight (e.g., linear) and/or arcuate (e.g., non-linear) portion(s). Also, the example rails 52*a* and 52*b* are illustrated as having the same construction (e.g. the same shape), the only difference being the orientation of the rails in relation to the upper corner housing 30 and the joint to which they are coupled. Still further, the example rails 52*a* and 52*b* may be substantially linear along their entire length, thereby lying in a plane that is non-coplanar with the plane of the floor. In still other examples each of the rails 52*a*, 52*b* may be constructed with different shapes as desired.

As noted above, the upper frame 22 is pivotally coupled to the upper corner housings 30. The housings 30 may be formed, for example, by molded plastic, formed metal, or the like. In the illustrated example, each upper corner housing 30 pivotally couples an end of one of the upper end rail members 50 to an end of one of the upper side rail members 52. Additionally, each upper corner housing 30 couples the rail members 50, 52 to an upper end of one of the upright corner posts 26. In this example, the upright corner posts 26 are fixedly coupled to the upper corner housings 30, while the ends of the rail members 50, 52 are pivotally coupled to the upper corner housings 30 via fasteners, such as bolts of the like, to facilitate folding of the playard 12.

The lower frame 24 of the example playard 12 includes four lower rail members 70 each having a first end 70*a* pivotally mounted to a respective one of the upright corner post 26, and a second end 70*b* pivotally mounted to a central hub 72. The example central hub 72 includes a releasable locking mechanism (not shown) to releasably maintain the playard 12 in the erected position shown, while allowing the playard 12 to be unlocked and folded in any desired manner. The example central hub 72 additionally includes two support members 74 pivotally mounted to the hub 72 to provide additional support for the playard 12 when in the erected position shown. The lower rail members 70 of the lower frame 24 may be constructed in a similar manner to the components of the upper frame 22 (e.g., as metal or plastic tubes). The lower frame 24 also includes lower corner housings 76 to join the lower rail members 70 and the lower ends of the corner posts 26. Furthermore, as illustrated in FIGS. 5-10, the example lower frame 24 provides a generally horizontal, generally planar support surface upon which the padded floor 46 may rest.

While the lower frame 24 of the example playard 12 is shown with a lower rails and a central hub assembly, any suitable lower frame assembly may be utilized. In particular, the lower frame 24 may include any combination of rail(s), hub(s), support mechanism(s), locking mechanism(s), etc. to provide support for the playard 12. Additionally, while the lower frame 24 of the example playard 12 is illustrated as being collapsible or foldable, the lower frame 24 may be constructed so as to be rigid (e.g., when the playard is implemented as a crib intended for non mobile usage).

In the illustrated example, each lower corner housing 76 couples an end of each of the lower rail members 70 to a lower end of the one of the upright corner posts 26. In the illustrated example, two of the lower corner housings 76 are provided with a ground engaging wheel assembly 78. Each wheel assembly 78 may be provided with a caster mechanism or may have a fixed axis of rotation. In the illustrated example, each wheel assembly 78 includes a single wheel with a fixed axis of rotation. Any other desired rotatable element may alternatively be used to produce movement over a ground surface. Additionally, any number of wheel assemblies (e.g., 0, 1, 2, 3, 4, etc.) may be used. Alternatively, fixed (non-rotatable) feet may be used.

Figure 11:
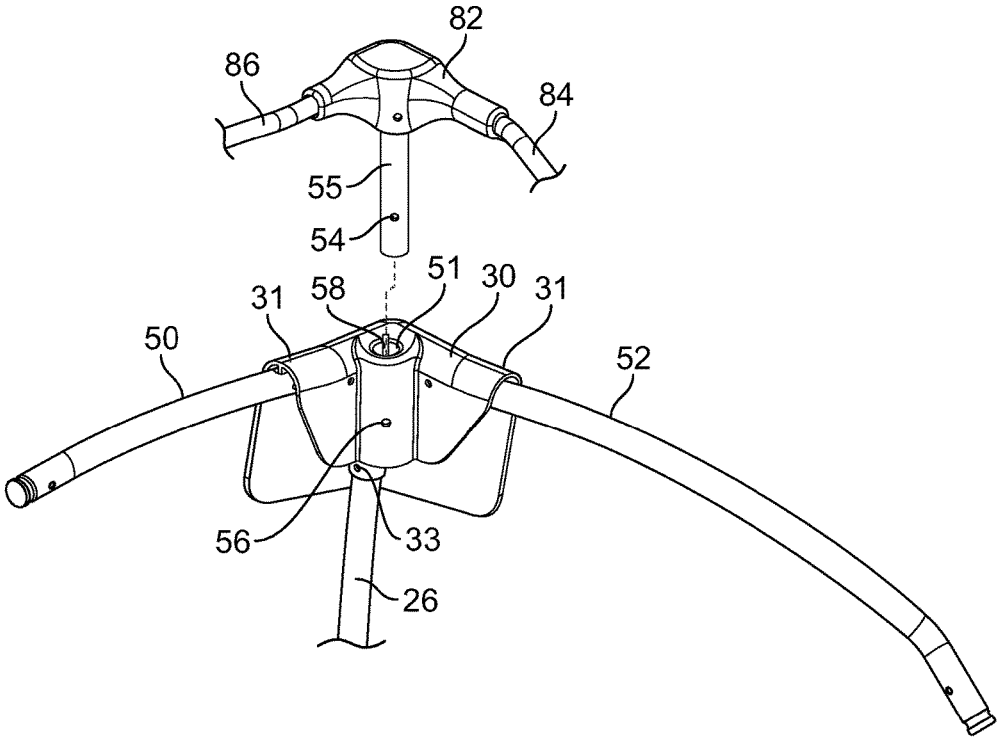
FIG. 11 is an enlarged partial perspective view illustrating the engagement of the example changing table with the example playard.
Figure 12:
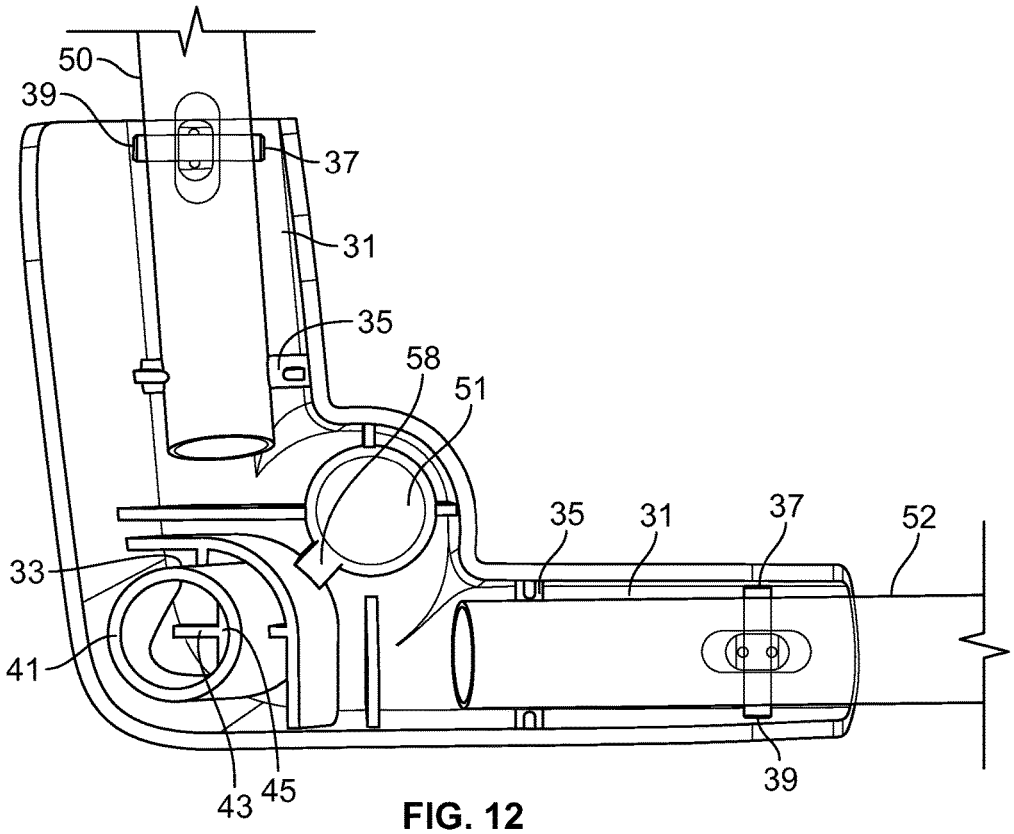
FIG. 12 is an enlarged bottom plan view illustrating the engagement of the example changing table with the example playard.
Figure 13:
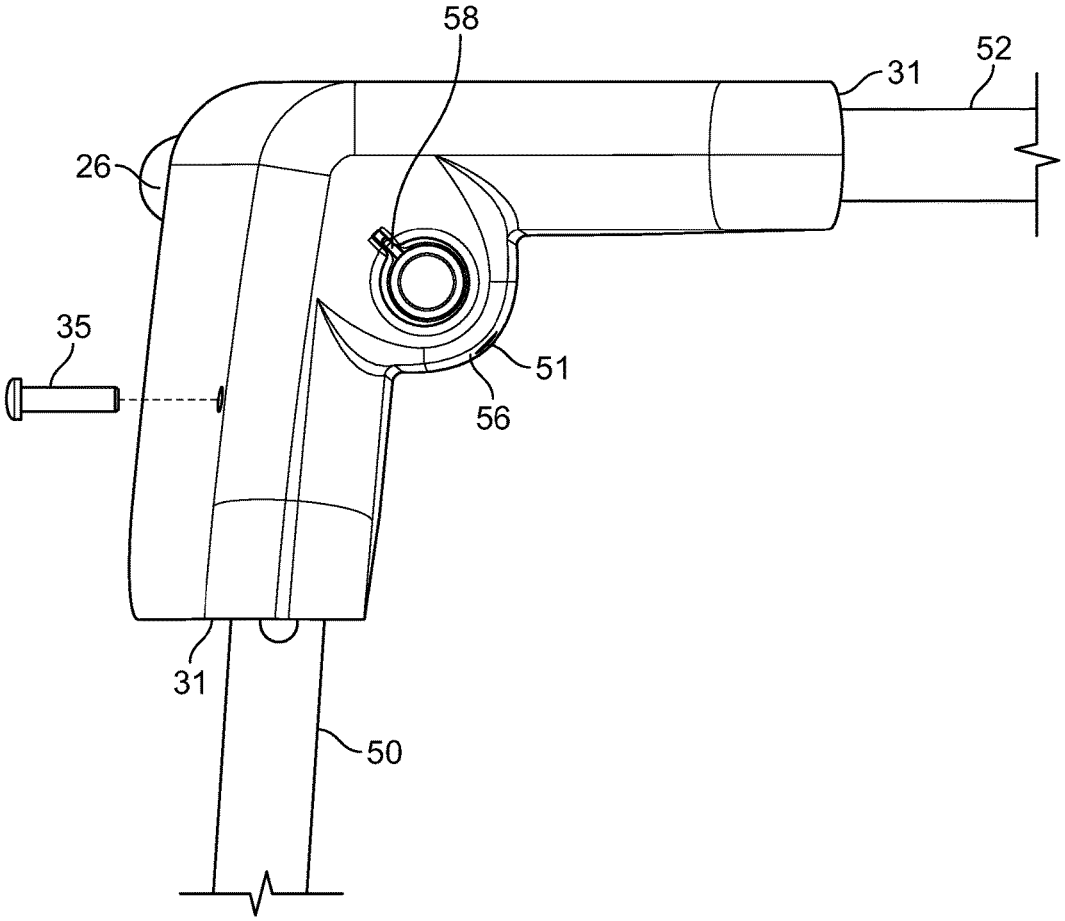
FIG. 13 is an enlarged top plan view illustrating the engagement of the example changing table with the example playard.

Turning to FIGS. 11-13, an example corner housing 30 and changing table 14 connection is shown. While the example of FIGS. 11-13 illustrate a changing table being coupled to the corner housing 30, any child care accessory, including, for example, the mobile 15, (FIGS. 1 and 2) may be mounted to the housing 30 in any suitable manner. In particular, each example upper corner housings 30 defines two generally horizontally disposed channels 31 and one generally vertically disposed socket 33. In this example, the horizontal channels 31 extend generally perpendicular to one another and are at least partially open to allow for pivotal movement of the rail members 50, 52 when the playard moves between the erected and collapsed positions. In the illustrated example, each of the channels 31, may deviate from horizontal (e.g., may be slightly off horizontal, may be arcuate, etc.) to conform to the shape of the rail members 50, 52, coupled thereto. The example channel 31 includes a pivot pin 35 to pivotally secure an end of the rail members 50, 52 to the upper corner housing 30. The pivot pins 35 allow for rotational movement of the respective rail members 50, 52 relative to the channel 31. In addition, the example rail members 50, 52 may include a spring-biased push button 37 such as a VALCO® push button and an aperture or detent 39 correspondingly located on an inner wall of the channel 31 to assist in at least partially retaining the rail members 50, 52 in their respective extended positions.

As shown in FIG. 12, the example vertical socket 33 extends generally orthogonal to both the horizontal channels 31 and is defined by a wall 41 that is sized to at least partially surround the upright corner post 26 and to substantially prevent lateral movement of the upright corner post 26 within the vertical socket 33. In the illustrated example, the wall 41 is a single continuous wall. However, the wall 41 may be formed by any number of walls as desired.

To prevent rotation of the post 26 within the socket 33, the example wall 41 includes a keyed portion 45 (e.g., a flattened area), while the post 26 includes a similarly dimensioned feature (not shown) to matingly engage the keyed portion 45 when the post 26 is properly inserted into the socket 33. In this example, the wall 41 of the socket 33 also includes a tab 43 and/or any other suitable feature, extending from a portion of the wall 41, while the post 26 includes a similarly dimensioned slot (not shown) to matingly engage the tab 43. Additionally, the example socket 33 may include a pin (not shown) insertable through at least a portion of the wall 41 of the socket 33 and at least a portion of the post 26 to fixedly secure an end of the upright corner post 26 to the socket 33, and to substantially prevent any relative longitudinal movement between the post 26 and the upper corner housing 30. However, any other suitable shape and/or device, such as, for example, a spring-biased push button (e.g., a VALCO® push button) may be employed to prevent the post 26 from moving within the socket 33. Furthermore, while the keyed portion 45 and the tab 43 are described as being formed with the wall 41, either of the keyed portion 45, the tab 43, and/or any other suitable device may be formed in either the post 26 or the socket 33. Still further, the socket 33 may include a plurality of detents, apertures, and/or other structure to support the child care accessory (e.g., the mobile 15 or the changing table 14) in a plurality of positions. In any configuration, the distance between the child care accessory and the upper frame may be designed to comply with all industry standards of safety (e.g., to avoid entrapment issues).

As shown in FIGS. 11 and 13, the example upper corner housing 30 also includes a second vertical socket 51 extending generally parallel to the socket 33. Thus, when in the erected position as shown in FIGS. 1-10, the socket 51 is disposed generally perpendicular (e.g., vertical) relative to the lower frame 24. In the illustrated example, the socket 51 is offset from the socket 33 and is disposed generally adjacent to the socket 33. Accordingly, in this example, when the playard 12 is in the erected position the socket 51 is located with at least a portion of the socket 51 below the channels 31, and therefore, below the rail members 50, 52. The socket 51 is dimensioned to matingly receive a projection depending from the changing table 14. As a result, the distance between the bottom of the frame of the changing table 14 and the top of the upper rail members 50, 52, (e.g., the gap) is maintained sufficiently small to avoid entrapment risks. In other examples, the location of the socket 51 relative to any of the channels 31, and/or the socket 33 may vary.

As mentioned above, the socket 51 is sized to releasably receive a projection (e.g., a mounting post 55) of the changing table 14. In particular, the mounting post 55 may be releasably inserted into the socket 51 to mount the changing table 14 to the playard 12. In this example, the mounting post 55 includes a spring-biased push button 54 such as a VALCO® push button. The socket 51 also includes at least one aperture or detent 56 correspondingly located in the socket 51 to releasably retain the mounting post 55 in the socket 51. Additionally, to permit only certain orientations of the mounting post 55 within the socket 51, the example socket 51 includes a keyed portion 58 (e.g., a slot), while the mounting post 55 includes a similarly dimensioned feature (e.g., a tab) (not shown). The keyed portion 58 may also assist in further preventing rotation of the mounting post 55 within the socket 51. However, any other suitable shape(s) and/or device(s), such as, for example, multiple slots and tabs may be employed to enforce alignment of the mounting post 55 within the socket 51. Furthermore, while the keyed portion 58 and the corresponding tab are described as being formed within the socket 51 and mounting post 55, respectively, either of the keyed portion 58, the tab, and/or any other suitable device(s) may be formed on either the socket 51 or the mounting post 55 in any combination.

Referring again to FIGS. 3-13, the example changing table 14 includes a changing table frame 80 and a pair of couplers 82. Each of the couplers 82 is provided with one of the mounting post 55 as described above for releasably coupling the changing table 14 with the upper corner housings 30. The example frame 80 includes a pair of side rails 84, a proximal end rail 86, and a distal end rail 88. The side rails 84, the proximal end rail 86, the distal end rail 88, and the mounting posts 55 may be constructed of any suitable material such as with relatively rigid (metal or plastic) tubing, or the like. Similarly, the coupler 82 may be constructed of any suitable material such as with a relatively rigid (metal or plastic) molding.

In the illustrated example, the side rails 84 are mounted to the couplers 82 such that the changing table 14 extends over at least a portion of the playard 12. The proximal end rail 86 is mounted to the couplers 82 such that the end rail 86 is located in substantial vertical alignment with the rail 50 of the playard 12, and so that the gap between the end rail 86 and the playard rail 50 (as measured by a vertical line) is less than one inch. Similarly, each of the example side rails 84 of the changing table 14 are formed such that the side rails 82 are in substantial alignment with the upper rails 52 of the playard 12. Accordingly, the gaps between the frame 80 of the changing table 14 and the upper rails 52 of the playard 12 (as measured by a vertical line) is less than one inch. The minimized gaps between the frame 80 and the upper rails 50, 52 of the playard 12 can be any size sufficiently small to eliminate entrapment hazards between the changing table 14 and the playard 12 when assembled.

Additionally, as shown, the example end rail 86 is sized to place the mounting posts 55 of the couplers 82 into alignment with the sockets 51 of the upper corner housings 30 of either end of the playard. Accordingly, the changing table 14 is selectively mountable to either end of the playard 12, and thus, the height of the changing table 14 above the lower frame 24 of the playard 12 may be selectively changed by moving the changing table 14 to the opposite playard end. Specifically, in the example of FIGS. 3, 5, 7, and 9, the changing table 14 is mounted to the upper corners housings 30 coupling the upper rails 50, 52 to the two taller vertical corner posts 27*a*. Therefore, when mounted to the upper corner housings 30 in this location, the changing table 14 is a distance D above the lower frame 24 (see FIG. 5).

In the example of FIGS. 4, 6, 8, and 10, the changing table 14 is mounted to the upper corners housings 30 coupling the upper rails 50, 52 to the two shorter vertical corner posts 27*b*. Therefore, when mounted to the upper corner housings 30 in this location, the changing table 14 is a distance D' above the lower frame 24 (see FIG. 6).

In the illustrated example, the frame 80 of the changing table 14 is rigidly formed and cannot collapse and/or fold. Furthermore, the frame 80 is rigidly coupled to each of the couplers 82. However, the frame 80 and/or the attachment between the frame 80 and any of the couplers 82 may be formed such that the changing table 14 is collapsible and/or foldable for storage or other purposes. Furthermore, the frame 80 may be formed such that at least a portion of the changing table 14 extends outside the footprint of the upper frame 22 of the playard 12. Still further, the changing table 14 may be formed with any number of compartment(s) and/or accessories, including, for example, storage compartments, child care product holders, fasteners, mobiles, etc.

Foldable and portable playard assemblies with a changing table and methods of using the same have been disclosed. The example playard includes vertical posts of at least two different heights and the example changing table may be mounted to either end of the playard to vary the height of the changing table relative to the lower frame of the playard.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

The invention claimed is:

1. A playard comprising:

a lower frame having a first end and a second end;

an upper frame including:

a first end including a first rail and a second rail coupled by a first joint; and a second end including a third rail and a fourth rail coupled by a second joint;

a first pair of support posts supporting the first end of the upper frame a first distance from the first end of the lower frame; and a second pair of support posts supporting the second end of the upper frame a second distance from the second end of the lower frame, the second distance being different from the first distance such that a vertical distance between the first joint and the lower frame is greater than a vertical distance between the second joint and the lower frame.

2. A playard as defined in claim 1, further including:

a first pair of corner housings coupled to the first pair of support posts and the first end of the upper frame to support a first child care accessory at a first height; and a second pair of corner housings coupled to the second pair of support posts and the second end of the upper frame to support the first child care accessory or a second child care accessory at a second height, the second height different than the first height.

3. A playard as defined in claim 1, the upper frame further including:

a first side including a fifth rail and a sixth rail coupled by a third joint; and a second side including a seventh rail and an eight rail coupled by a fourth joint.

4. A playard as defined in claim 3, wherein the first joint is opposite the second joint, and the third joint is opposite the fourth joint.

5. A playard as defined in claim 3, wherein the lower frame, when in an erected position, provides a generally horizontal support surface positioned in a first plane.

6. A playard as defined in claim 5, wherein when the upper frame is in an erected position, the first joint is positioned in a second plane, the second plane being parallel to the first plane.

7. A playard as defined in claim 6, wherein when the upper frame is in the erected position, the second joint is positioned in a third plane, the third plane being parallel to the first plane.

8. A playard as defined in claim 5, wherein when the upper frame is in an erected position, the third joint is positioned in a fourth plane, the fourth plane being transversely oriented relative to the first plane.

9. A playard as defined in claim 8, wherein when the upper frame is in the erected position, the fourth joint is positioned in a fifth plane, the fifth plane being transversely oriented relative to the first plane.

10. A playard as defined in claim 9, wherein the fifth plane is parallel to the fourth plane.

11. A playard as defined in claim 10, wherein the fifth plane is co-planar with the fourth plane.

12. A playard as defined in claim 3, wherein a center of the third joint and a center of the fourth joint are positioned a third distance from the lower frame, the third distance different than at least one of the first distance or the second distance.

13. A playard as defined in claim 12, wherein the third distance is less than the first distance and greater than the second distance.

14. A playard as defined in claim 3, wherein the fifth rail is generally downwardly curved relative to the lower frame and the sixth rail is generally upwardly curved relative to the lower frame.

15. A playard as defined in claim 14 wherein the third joint includes one or more linear portions disposed between the fifth rail and the sixth rail.

16. A playard as defined in claim 3, wherein the fifth rail is pivotally coupled to the sixth rail via the third joint.

17. A playard comprising:

a lower frame having a first end and a second end;

an upper frame including:

a first end including a first rail pivotally coupled to a second rail;

a second end including a third rail pivotally coupled to a fourth rail;

a first side including a fifth rail pivotally coupled to a sixth rail; and a second side including a seventh rail pivotally coupled to an eighth rail;

a first pair of support posts supporting the first end of the upper frame a first vertical distance from the first end of the lower frame; and a second pair of support posts supporting the second end of the upper frame a second vertical distance from the second end of the lower frame, the first vertical distance being greater than the second vertical distance.

18. A playard as defined in claim 17, wherein the fifth rail is generally downwardly curved relative to the lower frame and the sixth rail is generally upwardly curved relative to the lower frame.

19. A playard as defined in claim 18, wherein the seventh rail is generally downwardly curved relative to the lower frame and the eighth rail is generally upwardly curved relative to the lower frame.

20. A playard as defined in claim 17, further including:

a first pair of corner housings coupled to the first pair of support posts and the first end of the upper frame to support a first child care accessory at a first height; and a second pair of corner housings coupled to the second pair of support posts and the second end of the upper frame to support the first child care accessory or a second child care accessory at a second height, the second height different than the first height.

21. A playard as defined in claim 17, wherein the lower frame, when in an erected position, provides a generally horizontal support surface positioned in a first plane.

22. A playard as defined in claim 21, wherein when the upper frame is in an erected position:

a substantially linear portion of the first rail is positioned in a second plane;

a substantially linear portion of the second rail is positioned in a third plane;

a substantially linear portion of the third rail is positioned in a fourth plane;

a substantially linear portion of the fourth rail is positioned in a fifth plane;

a substantially linear portion of the fifth rail is positioned in a sixth plane;

a substantially linear portion of the sixth rail is positioned in a seventh plane;

a substantially linear portion of the seventh rail is positioned in an eighth plane; and a substantially linear portion of the eighth rail is positioned in a ninth plane.

23. A playard as defined in claim 22, wherein the second plane is parallel relative to the first plane, the fourth plane is parallel relative to the first plane, and the second plane is non-coplanar relative to the fourth plane.

24. A playard as defined in claim 22, wherein the second plane is parallel relative to the first plane, the seventh plane is parallel relative to the first plane, and the second plane is non-coplanar relative to the seventh plane.

25. A playard as defined in claim 22, wherein respective ones of the second plane and the third plane are parallel relative to the first plane and coplanar relative to one another, respective ones of the fourth plane and the fifth plane are parallel relative to the first plane and coplanar relative to one another, and respective ones of the second plane and the third plane are non-coplanar relative to respective ones of the fourth plane and the fifth plane.

26. A playard as defined in claim 22, wherein respective ones of the second plane, the third plane, the sixth plane and the eighth plane are parallel relative to the first plane and coplanar relative to one another, respective ones of the fourth plane, the fifth plane, the seventh plane and the ninth plane are parallel relative to the first plane and coplanar relative to one another, and respective ones of the second plane, the third plane, the sixth plane and the eighth plane are non-coplanar relative to respective ones of the fourth plane, the fifth plane, the seventh plane and the ninth plane.

* * * * *